power to the electroslag-remelting apparatus which is displacing the electrode carriage 21 along the guide

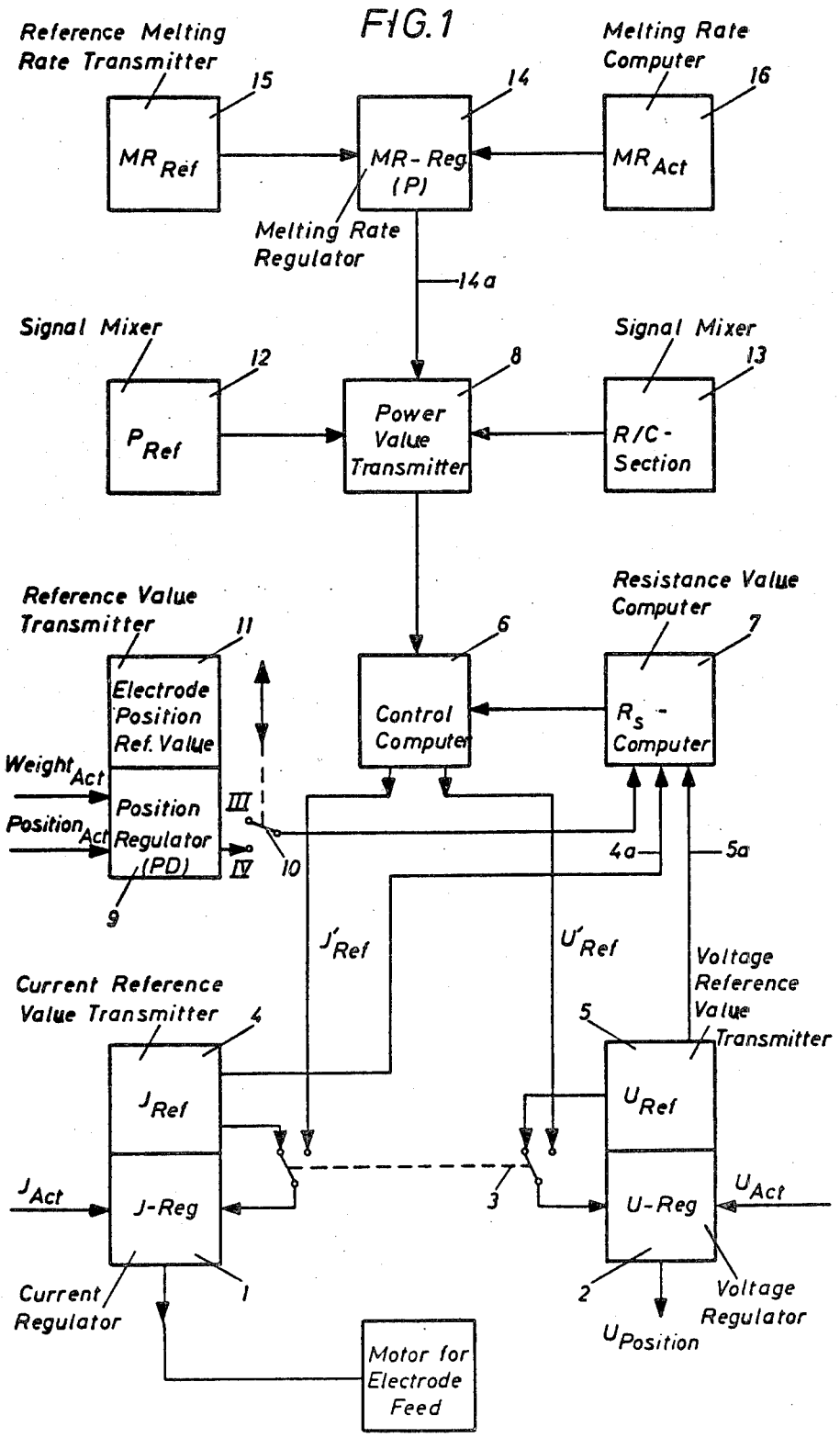
FIG. 1
Reference Melting Rate Transmitter
15
MR Ref
14
MR-Reg (P)
Melting Rate Regulator
Melting Rate Computer
16
MR Act
14a
Signal Mixer
12
P Ref
8
Power Value Transmitter
Signal Mixer
13
R/C-Section
Reference Value Transmitter
11
Electrode Position Ref. Value
Weight Act
Position Act
Position Regulator (PD)
9
III
IV
10
6
Control Computer
Resistance Value Computer
7
Rs - Computer
4a
5a
J'Ref
U'Ref
Current Reference Value Transmitter
4
JRef
JAct
J-Reg
1
Current Regulator
Motor for Electrode Feed
3
Voltage Reference Value Transmitter
5
URef
UAct
U-Reg
2
Voltage Regulator
UPosition 35
27

45
31
27'
28
32'
28
30
27'
45
35
27

32'

METHOD AND APPARATUS FOR REGULATING THE MELTING RATE OF AN ELECTRODE DURING ELECTROSLAG REMELTING

BACKGROUND OF THE INVENTION

The present invention relates to a new and improved method and apparatus for regulating the melting rate of a self-consuming electrode in a slag bath during electroslag remelting.

In Austrian Pat. No. 345,487 it has already been proposed to keep constant the current required for remelting in that, upon deviations from a reference or set value there is altered the lowering or immersion speed of the electrode which is to be melted. This electrode lowering speed is increased when the current is too low and reduced when the current is too high. Moreover, when the current is maintained constant in this manner there is increased the bath potential for the purpose of inputting a greater amount of actual or nonreactive power when the lowering speed of the electrode is too low with respect to a predetermined lowering speed. This enables increasing the melting rate, and thus, the lowering or immersion speed of the electrode. Conversely, if this lowering speed is too high the bath potential is reduced.

However, when practicing this method there is not afforded the possibility of intentionally proportionally influencing the melting rate, because with the adjustment of the bath potential or voltage, there is, in turn, altered the lowering or immersion speed of the electrode. For instance, when the current is regulated to be constant a voltage increase would cause a reduction in the immersion depth of the electrode into the molten bath, whereby, however, the melting rate generally would not proportionally increase. Due to metallurgical reactions in the molten bath the bath resistance is altered during the course of the melting time. If the bath potential and current are maintained constant the electrode will immerse to a greater extent into the molten bath if, for instance, the bath resistance increases. Thus, the melting rate is again altered.

The aforedescribed effects do not allow for any constant remaining remelting conditions. However, for metallurgical reasons it is of great importance to establish a melting rate which is controllable, for instance a constant melting rate, because the parameters influencing the melting rate and also the immersion depth of the electrode into the molten bath are multifarious and cannot be precisely calculated if melting rate and immersion depth are to be supervised by regulation techniques or methods.

According to German Pat. No. 1,934,218, for instance, the melting weight of a self-consuming electrode is regulated according to a weight-time function without taking into account an electrode spacing which is to be maintained. In German Pat. No. 2,456,512 the immersion depth is regulated according to the bath resistance or its gradients, without monitoring the melting rate. The aforementioned reasons make it readily apparent that regulation of the immersion depth as a function of the bath resistance is very inexact.

The heretofore known methods for regulating the melting rate are afflicted with the disadvantage that such regulation only is performed according to the advance or feed speed of the electrode, the voltage and the current intensity. However, the position of the electrode in the slag bath and its distance from the melt level or meniscus are not taken into consideration. Yet, for the metallurical characteristics of the ingot or block to be molten the thermal conditions during solidification are extremely important. The deeper the electrode immerses into the slag bath, the higher the temperature of the still liquid ingot or block and the deeper the sump of liquid metal formed in the ingot or block. Furthermore, the melting rate is not a linear function of the immersion depth, which makes the immersion depth an essential control parameter or magnitude.

SUMMARY OF THE INVENTION

Therefore, it is a primary object of the present invention to provide a new and improved method and apparatus for regulating the melting rate of a self-consumable electrode during electorslag-remelting in a manner which is not associated with the aforementioned drawbacks and limitations of the prior art.

The inventive method for regulating the melting rate of a self-consumable electrode during electroslag remelting in a slag bath, wherein the lowering speed of the remeltable electrode determined by a length measurement, is regulated with respect to the maintenance of a set or reference value of the melting rate and with respect to the current intensity and/or the voltage, essentially is manifested by the features that there is continually determined the weight of the portion or part of the electrode immersed into the slag bath from the actual total weight of the electrode and the length of the electrode extending above the surface of the slag bath. This weight is continuously compared with a set or reference value and in the event of a deviation therefrom there is altered the quotient of $U_{Ref}$ and $J_{Ref}$, wherein U and J denote potential and current, respectively, and the product of $U_{Ref}$ and $J_{Ref}$ remains constant. The actual melting rate is compared with a set or reference melting rate, so that in the event of a deviation there is correspondingly altered the product of $U_{Ref}$ and $J_{Ref}$. The part by weight of the electrode which is immersed in the slag bath can be easily calculated from the difference of the weighed weight of the electrode, which equally can be determined by means of the weight of the already molten ingot or block, and the length of the electrode extending above the surface of the slag bath surface, which serves for computing the weight of the electrode above the slag bath, and in the event of a deviation the resistance is altered, however the product of current intensity and voltage is maintained constant. Then the actual melting rate, i.e. the melted weight of the electrode per unit of time is compared with a set or reference melting rate and in the event of a deviation the product is accordingly altered or changed.

In principle, the remelting process can be compared to a 2-magnitude or parameter regulation loop, wherein the bath potential or voltage $U_{WB}$ and the current J constitute input magnitudes, i.e. adjustment or setting magnitudes, and the melting rate and the immersion depth $\Delta b$ or the immersion weight $\Delta G$, respectively, of the electrode constitute output magnitudes. Generally, there are provided separate regulators for maintaining the voltage $U_{WB}$ and the current J, the set or reference values of which can be separately adjusted or set.

For maintaining constant the electrode immersion depth in the molten bath, with subsequent alteration of the bath actual power $P_{WB}$, there is required decoupling of the regulation magnitudes. This decoupling can be accomplished by means of a control computer which calculates from a predetermined bath active power $P_{WBS}$ to be delivered to the bath and from the melting bath resistance $R_B$ the voltage and current reference values $U_{WBS}$ and $J_S$ for the regulators according to the relationships $$U_{WBS} = C_U \sqrt{P_{WBS} R_B}$$

$$J_S = C_J \sqrt{P_{WBS}/R_B}$$

wherein $C_U$ and $C_J$ are correction values for non-linearities of the resistance $R_B$.

According to a further feature of the invention the lowering or immersion speed of the electrode is controlled through the set or reference value of the current intensity. In this regard there must be considered that, during the melting of the electrode the ingot or block grows towards the electrode. By controlling the lowering speed of the electrode by means of the current intensity it is possible to more exactly maintain this lowering speed or velocity, which renders possible an even more exact maintenance of the melting conditions.

According to a preferred feature of the invention the weight of the electrode is weighed, affording a most precise determination of the weight. By means of this weight measurement there can be determined most easily considerations or system aspects which are predicated upon weight, such as current infeed lines, electrode supports, buoyant action exerted upon the electrode by the slag bath, and so forth.

The apparatus according to the invention, according to one preferred embodiment, and which is provided with a voltage or current regulator connected to a positioning or adjustment device for lowering the electrode, and with a voltage regulator connected to a positioning device for adjusting the tap of a positioning or adjustment transformer which powers or supplies the remelting plant, essentially is manifested by the features that, the current regulator and voltage regulator are connected to a control computer which calculates the set or reference values for these regulators. This control computer, in turn, is connected to a resistance value computer which delivers the resistance value serving for determining the set or reference values for the current and the voltage, and to a melting rate regulator which, preferably, is influenced by a power value transmitter. This renders possible a particularly favourable decoupling of the regulation magnitudes and allows for an easy control of both the resistance and the melting rate, so that the desired temperature conditions in the liquid ingot or block can be maintained.

The part of the electrode which immerses into the liquid slag can be particularly exactly controlled with respect to a set or reference value if the resistance value computer is connected to a positioning regulator. This positioning regulator compares the position of the electrode in relation to the slag bath surface with a set or reference value. This positioning regulator, in turn, is connected to a computer for determining the melting weight of the electrode from the melting length thereof, and to a measuring device for directly determining the melting weight of the electrode.

If the positioning regulator contains a correction device which, upon exceeding a certain differential value between the directly determined melting weight and the melting weight which has been determined from the melting length of the electrode, fixes or maintains, for instance, the last determined value, then also in this case there is rendered possible an automatic regulation even if the electrode contains large pipes or blow holes or the like. This is so because the electrode is not withdrawn from the slag bath by reason of the seemingly excessive melting rate.

If for the continuous measuring of the weight of the electrode there is interposed between a raising and lowering device for elevationally displacing the electrode a force measuring device which is capable of taring to zero dead loads, such as the electrode support, and if this force measuring device is connected to the melting rate regulator by means of a device which delivers a signal corresponding at least approximately to the time differential of the measured value, then it is possible, on the one hand, to precisely determine the weight of the electrode and, on the other hand, to also precisely determine and maintain the melting rate by means of the aforementioned device. This is so because the weight measurement of the electrode takes into consideration in an extremely accurate fashion the actual conditions during the remelting process. Especially at the end of the remelting process this accuracy is of great importance, since then there mostly is present only an electrode which is relatively small and therefore has little weight, and also there must be maintained, depending upon the operational requirements, a relatively low melting rate.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a block circuit diagram of an apparatus for performing the method according to the invention;

DETAILED DESCRIPTION OF THE PREFERRED EMBODIMENTS

Figure 2:
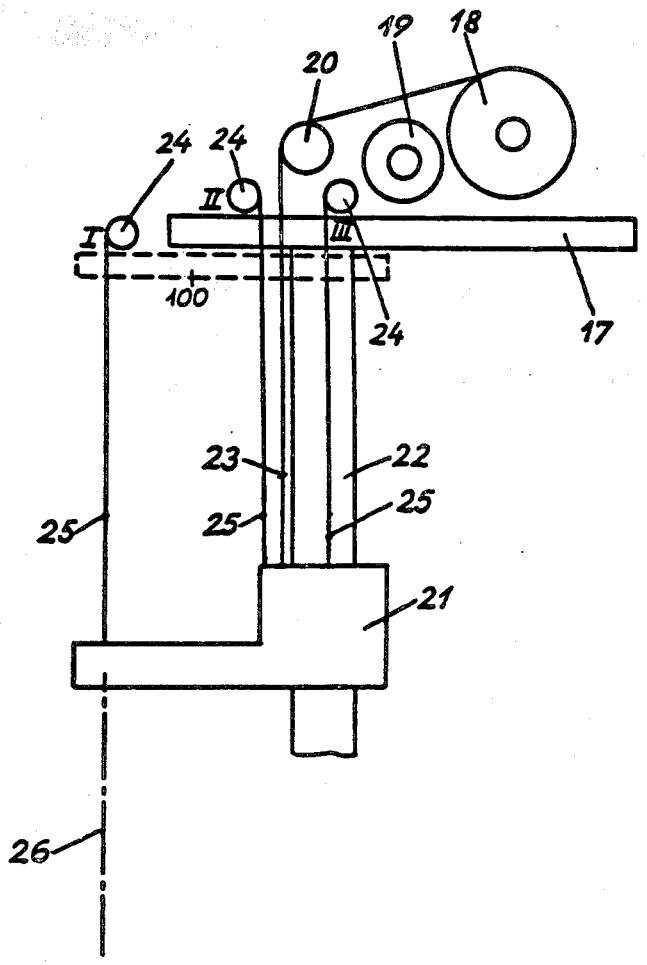
FIG. 2 is a schematic illustration of a number of possible arrangements of devices for determining the lowering or immersion path of the electrode.

Describing now the drawings, in the exemplary embodiment according to FIG. 1 the current regulator 1 and the voltage regulator 2, connected to not particularly illustrated but conventional actual value transmitters and adjustment or positioning devices which have been merely schematically indicated by the arrows $J_{Act}$ and $U_{Act}$, are selectively connected via switch means 3 to a current-reference or set value transmitter 4 and a voltage-reference value transmitter 5, respectively, or with a control computer 6. The positioning or adjustment device connected to the current regulator 1 acts upon a suitable electrode raising and lowering or elevational positioning device for actuating the self-consumable electrode for regulating or adjusting the lowering or immersion speed thereof, whereas the positioning or adjustment device connected to the voltage regulator 2 acts upon the tap of a regulating transformer supplying power to the electroslag-remelting apparatus which is of conventional design and therefore here not further illustrated in the drawings. The control computer 6 is connected with a resistance computer 7 and with a power value transmitter 8 to which there are connected the signal mixers or circuit sections. This control computer 6 supplies the current regulator 1 and the voltage regulator 2 with the required power value and the respective set or reference current and voltage values $J'_{Ref}$ and $U'_{Ref}$ which are dependent upon the resistance value delivered by the resistance computer 7.

In the control computer 6 there are arranged the appropriate adjustable limiter means or the like for setting the upper and lower thresholds of the bath active power. The portion or part of the signal delivered by the power value transmitter 8 to the control computer 6 is adjustable by means of the signal mixer 12, 13 and to which there is connected the positioning or adjustment magnitude output 14*a* of the melting rate regulator 14. By means of the signal mixer 12, 13 there is adjusted or set the regulation and control proportion or part (R/C). With a control proportion or part of 100% the signal of the power value transmitter 8 is fully effective in the control computer 6 and vice versa.

The resistance value computer or resistance computer 7 is connected by means of the lines 4*a* and 5*a* with the current and voltage reference value transmitters 4 and 5, respectively, and calculates from the values received therefrom a base value $R_o$ of the resistance. This resistance base value $R_o$ is corrected in accordance with a signal delivered by a position regulator 9 and can be inputted by means of a switch 10. The position regulator 9, in turn, is connected with a reference or set value transmitter 11 for the electrode immersion weight and immersion depth (position) and an actual value transmitter, merely schematically indicated by the arrows labelled $weight_{Act}$ and $position_{Act}$ at the left side of the position regulator 9, for the actual-immersion weight and immersion depth (position) of the electrode. From these values there is calculated the weight of the immersed portion or part of the electrode, which is compared with the set or reference values, and in the event of a deviation there is altered the quotient of $U_{Ref}$ and $J_{Ref}$, while the product is maintained constant. Furthermore, the positioning regulator 9 is provided with a correction logic and computer unit or device, which evaluates both of the actual melting rates from the weight and length measurement and upon exceeding a certain differential value carries out corrections, for instance by maintaining the last determined value.

The melting rate regulator 14 receives its set or reference value—the reference melting rate $MR_{Ref}$—from a melting rate transmitter 15 and its actual value from a melting rate computer 16. By differentiating or difference forming within finite time intervals of the preferably directly determined melting weight of the electrode this melting rate computer 16 delivers a signal which preferably corresponds to the actual melting rate ($MR_{Act}$).

In FIG. 2 there are schematically illustrated various possibilities of arranging the measuring devices for determining the lowering or immersion path of the self-consumable electrode.

Arranged at a cable winch platform 17 is a cable winch 18 or equivalent structure and its drive 19 as well as a cable guide roll 20. Guided over this cable guide roll 20 is a cable 23 which is attached to an electrode carriage or slide 21, this cable 23 or the like serving for displacing the electrode carriage 21 along the guide column 22. Furthermore, there are arranged upon the cable winch platform 17 or, as indicated by phantom or broken lines, upon a carrier arm or bracket 100 connected to the guide column 22 measuring value transmitters 24 for monitoring the displacement or adjustment movements of the electrode. These measuring value transmitters 24 are connected to the electrode carriage 21 by means of measuring chains 25 which advantageously extend exactly in vertical direction, so that due to rotation of a sprocket wheel or gear of the measuring value transmitter 24 meshing with the measuring chain 25 through the same angular amount corresponds to the same changes of the elevational position of the electrode.

With respect to the various possible installation or mounting locations of a measuring value transmitter 24, designated by reference numerals I, II and III, the installation location I delivers the most accurate measuring values, since according to this technique the measuring chain 25 practically extends along the lengthwise axis 26 of the electrode. Therefore, the bending of the electrode carriage or slide 21, which is reduced during the course of melting of the electrode, is not a factor which is incorporated into the measuring result, whereas this is the case to an increasing extent when the measuring value transmitters 24 are mounted at locations II and III.

Figure 3:
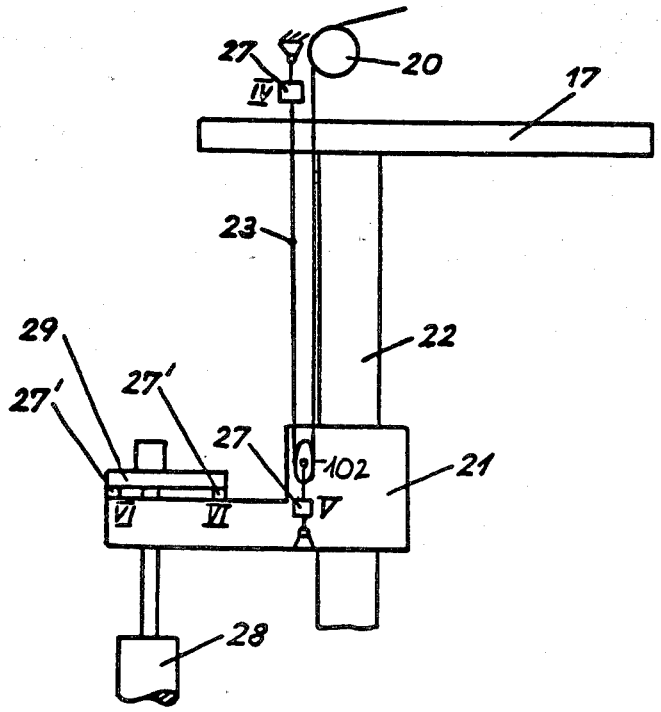
FIG. 3 is a schematic illustration of various arrangements of measuring devices for directly measuring the weight of the electrode.

FIG. 3 schematically illustrates the possibilities of arranging force-measuring value pick-ups or receivers. In an arrangement wherein the cable 23 is guided in a substantially pulley-block-like fashion a pick-up or receiver for the force-measuring values, constructed as a tension-force measuring cell 27, can be directly built into or otherwise incorporated in the cable run (arrangement IV) kept at a fixed point. Such tension-force measuring cell 27 equally can be arranged at a location where it picks-up or detects half the weight of the electrode carriage 21 together with the electrode 28, apart from the negligible weight of the cable run and the friction forces between the electrode carriage 21 and the guide column 22, and which weight, of course, changes during lowering of the electrode 28 and the electrode carriage 21. It is possible, of course, to tare the weight part of the electrode carriage 21 by means of a subsequently arranged suitably structured evaluation circuit and from the corrected signal there can be formed the time differential or the difference within finite but very small time intervals.

In contrast thereto, a tension-force measuring cell 27 remains uninfluenced by the changing weight of the cable if it is interposed, as with the mounting location V, between the loose or dancer roll 102 of the pulley-block-like cable guide and the electrode carriage 21. However, in this case the tension-force measuring cell 27 must take-up the full weight of the electrode carriage 21 with the electrode 28. At this installation or mounting location V the pick-up for the measuring values equally must take-up a great tare weight, i.e. the electrode carriage or slide 21.

On the other hand, at the installation or mounting locations VI there are provided pressure measuring cells 27' which are supported at the electrode carriage 21 and carry a weighing platform 29 at which there is supported, in turn, the electrode 28. This results in a comparatively smaller tare weight than with the mounting locations IV and V. Furthermore, there is omitted the effects of frictional forces between the electrode carriage 21 and the guide column 22.

In FIGS. 4 to 15 there are schematically illustrated various possibilities of supporting and establishing electrical contact for the electrode 28 and which equally affect to a greater or lesser degree the measuring or measurement result of the direct weight measurement of the electrode 28 for determining the actual melting rate.

Figure 4:
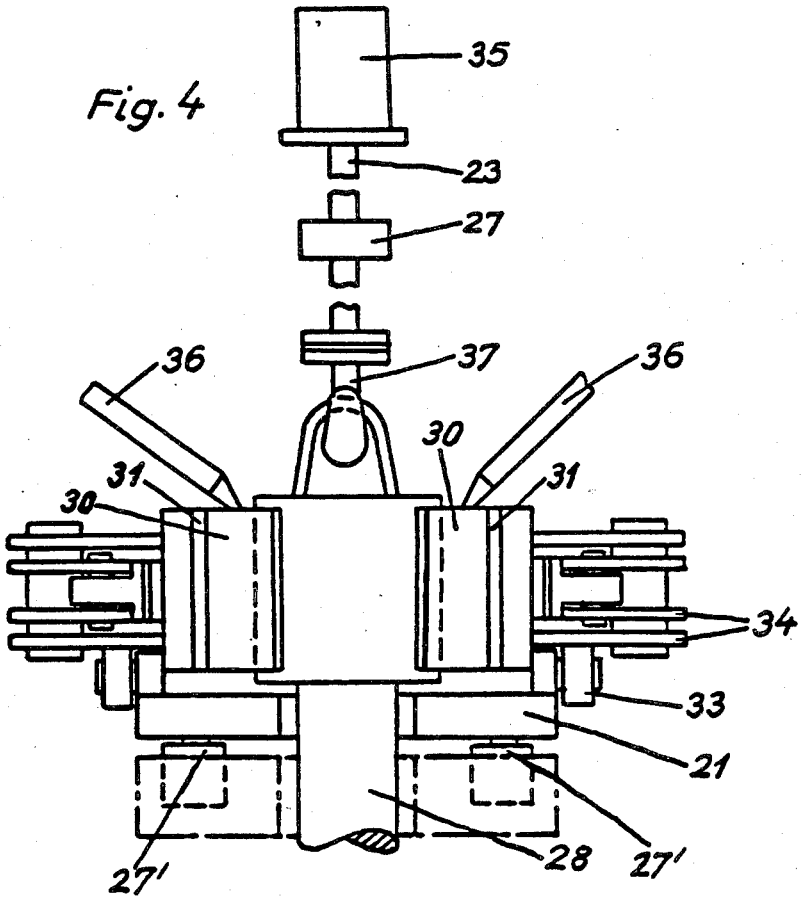
FIGS. 4 to 16 illustrate various possibilities of arranging the weight measuring devices at different constructions of electrode supports.
Figure 5:
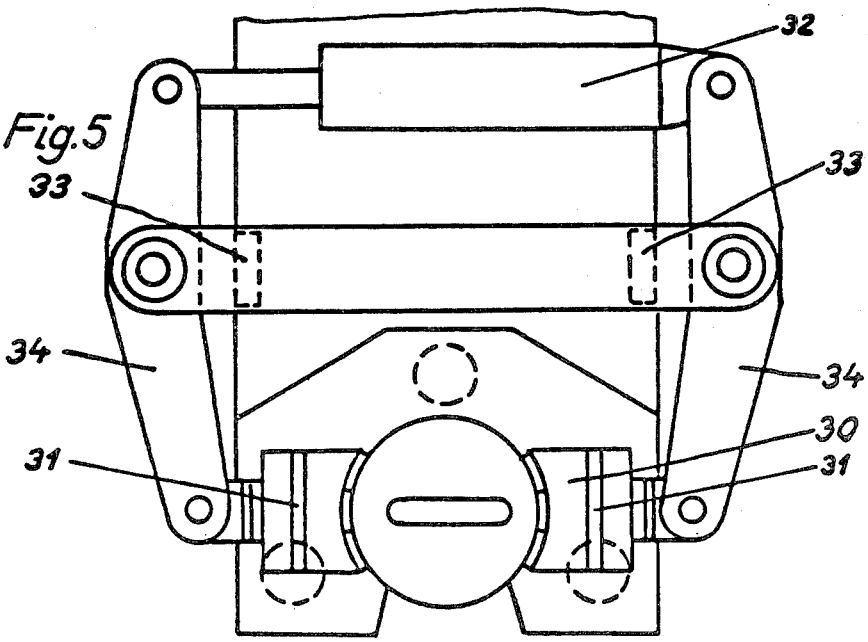

With the embodiment according to FIGS. 4 and 5, shown in elevational and plan view, respectively, the contact jaws 30 are secured to a pressing device while interposing suitable insulation 31. This pressing or contact device essentially is composed of two levers 34 which are operatively interconnected by means of a hydraulic cylinder unit 32 or equivalent structure and hinged to a rocker bearing arrangement 33. The rocker bearing arrangement 33 allows for a pivoting movement of the swivel or pivot levers 34 about the lengthwise axis of the rocker bearing arrangement 33 which is secured to the electrode carriage or slide 21. By means of a lifting hydraulic unit or system 35 mounted at the electrode carriage 21 the electrode 28 can be lifted off from its support at the electrode carriage 21 by means of the cable 23 and the thereto attached insulated grasping hook 27 or the like. At the cable 23 there is arranged a tension-force measuring cell 27. This lifting-off action is necessary in order to eliminate force shunts or by-pass paths caused by an electrode head resting upon the electrode carriage or slide 21. The raising and lowering of the electrode 28 itself is performed by means of the electrode carriage or slide 21.

The indicated weighing platform with the measuring cells 27' for pressure or compressive forces constitutes an alternative to weighing by means of measuring cells responsive to tension or traction forces. When suspending the electrode 28 the pressure-force measuring cells 27' must be relieved.

The current infeed lines 36 are directly connected to the contact jaws 30 and are preferably extremely flexible.

With this embodiment the weight measurement of the electrode 28 is only influenced by a very small tare weight, because the weight of the contact jaws 30 together with the portions of the lever 34 facing the contact jaws 30 roughly corresponds to the weight of the hydraulic cylinder 32 together with the portions of the levers 34 which are hinged thereto. However, frictional forces occurring at the hinges of the pressing or contact device enter the weight measurement.

Figure 6:
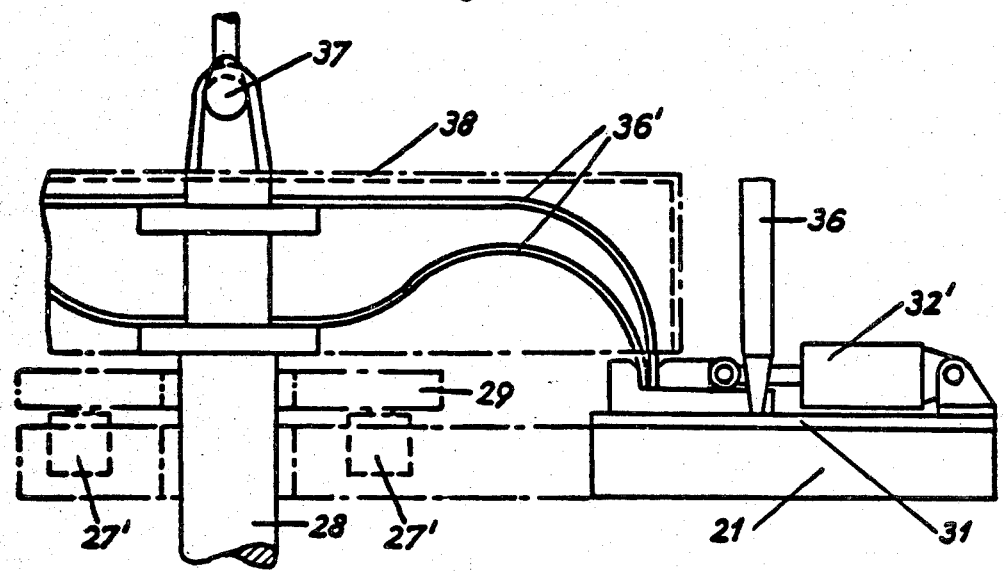
Figure 7:
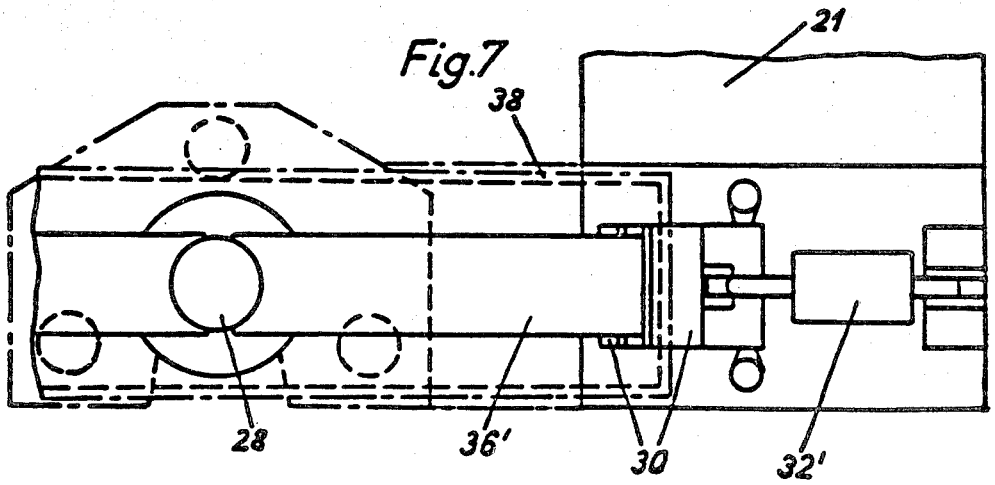

With the embodiment according to FIGS. 6 and 7 there are welded to the head of the electrode 28 flexible copper bands or strips 36'. These copper bands or strips 36' can be connected to the contact jaws 30 which can be closed by means of the hydraulic cylinder 32'. These contact jaws 30 are seated upon insulation 31 arranged at the electrode carriage or slide 21. The current infeed lines 36 to the contact jaws 30 can be rigid or stiff because they do not affect the measurement. Just as was the case for the embodiment according to FIGS. 4 and 5, the electrode 28 is suspended at an insulated hook 37. By means of a cable provided with a tension-force measuring cell this hook 37 is connected to the lifting hydraulic unit or system, or else is supported upon a weighing platform 29. This results in a very small tare weight, i.e. the hook 37, the cable or the weighing platform 29, a part of the weight of the copper bands 36' and the protection cabinet or box 38 enclosing the same. However, due to heating the copper bands 36' are subject to unavoidable alterations in their flexural or bending strength which are incorporated into the measurement. Yet, this embodiment affords the advantage of an especially small tare weight and an exceedingly simple construction.

Figure 8:
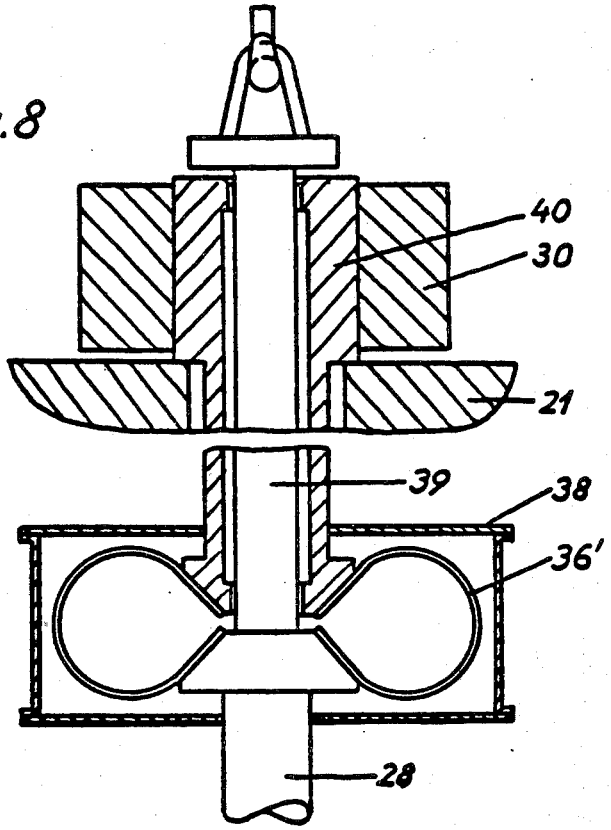
Figure 9:
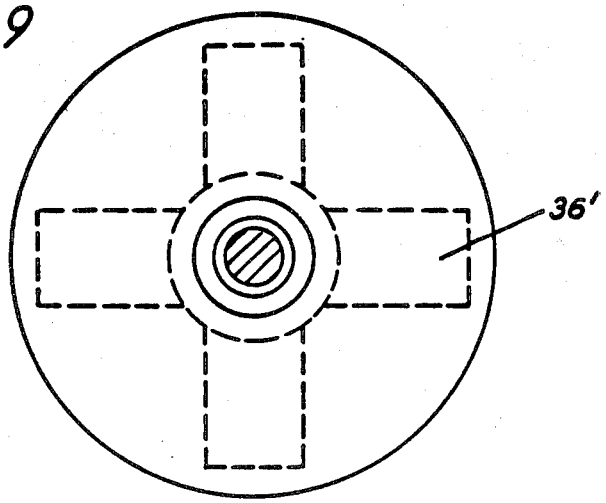

FIGS. 8 and 9 illustrate further embodiments, wherein the tare load acting upon the pick-ups or receivers for the force measuring values is very small. This enables selecting force-measuring pick-ups or receivers which have a correspondingly small measuring range, and thus, beneficially respond more sensitively to force changes.

With this embodiment the electrode 28 is provided with an armature rod 39 which penetrates through a bushing or sleeve element 40 which is supported at the electrode carriage or slide 21. The contact jaws 30 engage at this sleeve element 40 which is connected to the electrode 28 by means of copper bands or strips 36', which are enclosed by means of a protection cabinet or box 38. With this embodiment the electrode 28 is weighed by a weight-measuring device which engages thereat by means of an insulated hook and contains a tension-force measuring cell. The raising and lowering of the electrode 28 is performed by means of the electrode carriage or slide 21, at which there are supported the sleeve element 40 and the contact jaws 30.

By virtue of this construction the measurement is no longer affected by the weight of the protection cabinet or box 38, since the latter is supported at the sleeve element 40.

Figure 10:
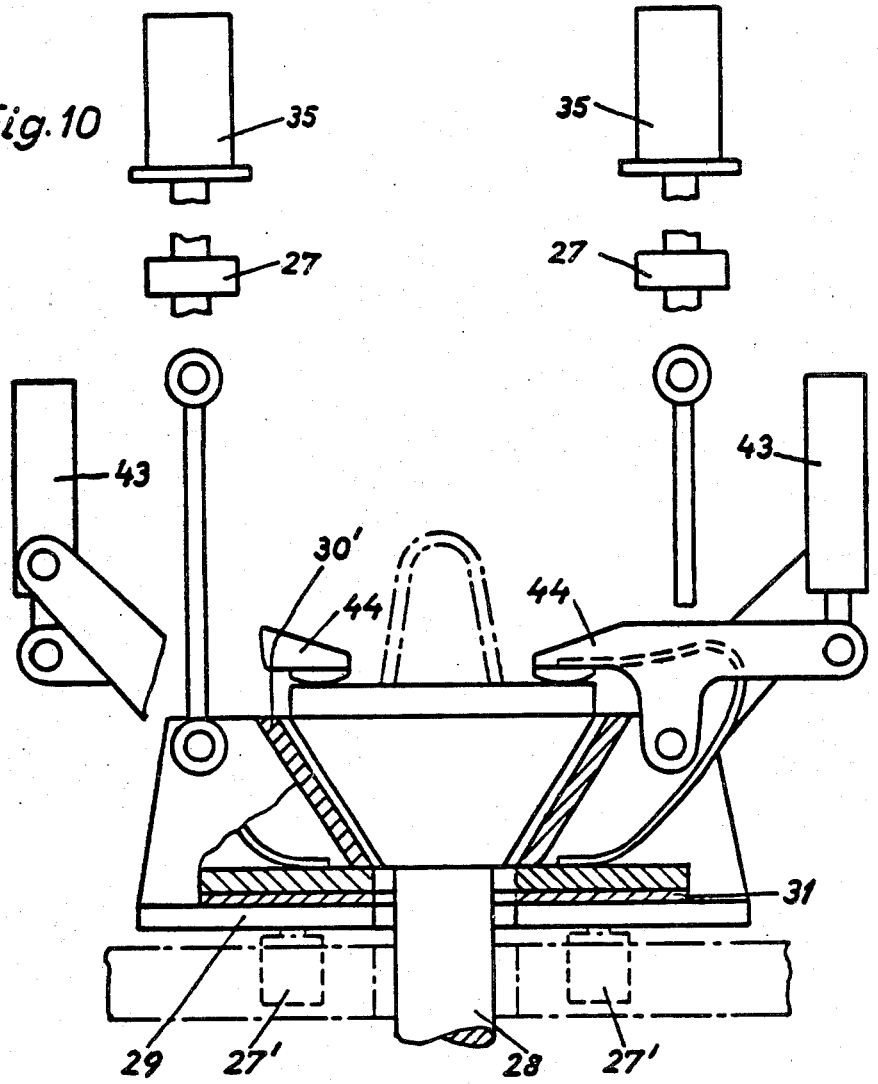
Figure 11:
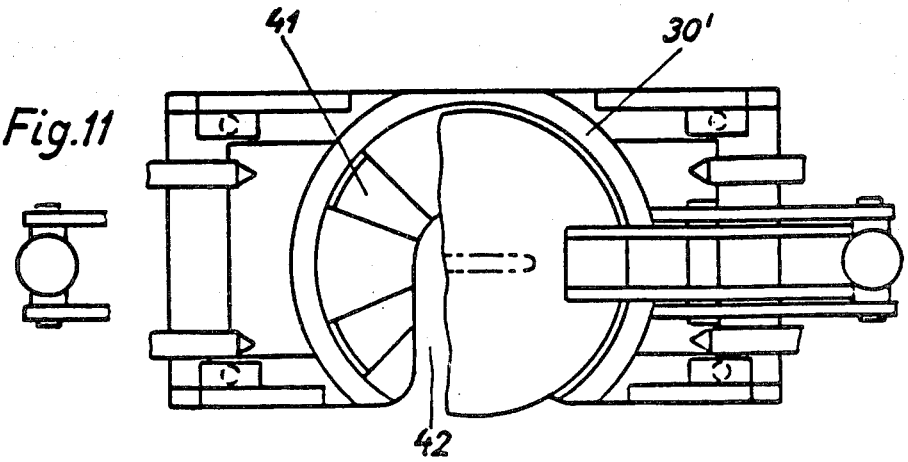

With the embodiment according to FIGS. 10 and 11 the lifting and lowering device—provided with the force-measuring device 27 or 27' and formed either by the separate lifting hydraulic unit or system 35 or by the cable winch of the electrode carriage, not illustrated in FIGS. 10 and 11—, in the event there are used a weighing platform 29 and pressure-force measuring cells 27', engages at the contact jaw 30'. This contact jaw 30' is supported upon the weighing platform 29 or the electrode carriage, respectively, so as to be insulated either by means of the insulation 31 or directly by means of the electrode carriage. The contact jaw 30' is provided with a self-adjusting surface which extends, for instance, in a substantially cone-shaped fashion and in which there are arranged contact blocks 41. This self-adjusting surface of the contact jaw 30' is provided with a slot 42 which substantially corresponds in size to the diameter of the rod of the electrode 28. Through this slot 42 there can be laterally inserted the rod of the electrode 28 which is provided, for instance, with a substantially conical head, which thus can be seated in the substantially cone-shaped contact jaw 30'. If the weight of the electrode 28 is not sufficient for achieving a faultless electrical contact in the contact jaw 30', then there can be attained an increase in the contact pressure exerted by the conical head of the electrode 28 upon the contact blocks 41 of the contact jaw 30' by means of the clamping arms 44 which are actuatable by means of the hydraulic cylinder means or unit 43.

The contact jaw 30' beneficially is attached to the lifting hydraulic system 35 by means of a Cardan-joint suspension through the tension-force measuring cells 27, or supported at the weighing platform 29. To increase the measuring precision it is beneficial, with the embodiment under discussion, to use extremely flexible copper bands or strips for the current supply.

Figures 12, 13:
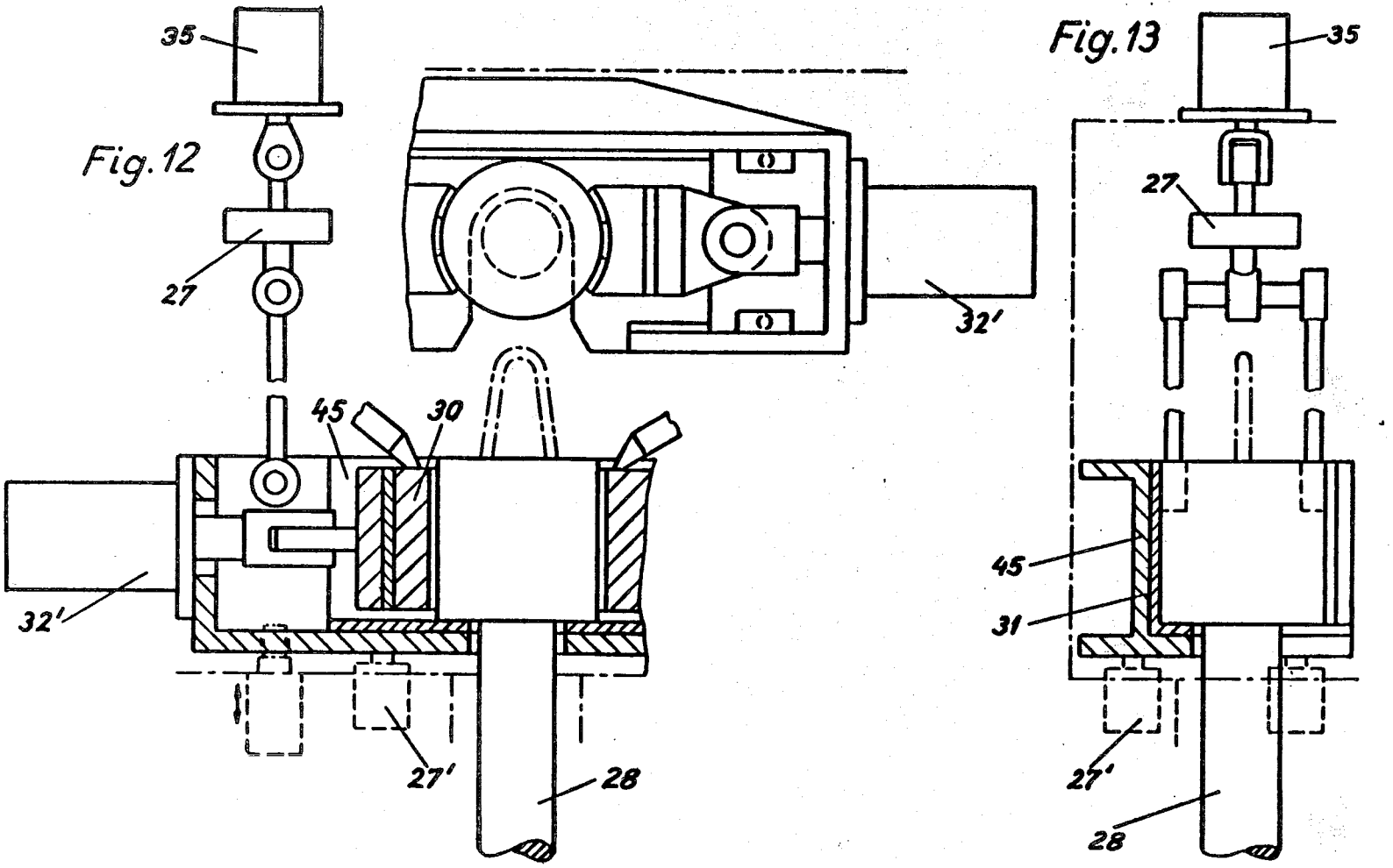

A similar embodiment is portrayed in FIGS. 12 and 13, but instead of one cone-shaped contact jaw 30' here there are employed two contact jaws 30 between which the head of the electrode 28 can be clamped. These contact jaws 30 are provided with two substantially cylindrical surfaces and are movable towards each other by means of two hydraulic cylinders 32'. When using tension-force measuring cells 27, wherein one of them may be found to be sufficient, as shown by referring to FIG. 13, the cables connected to these measuring cells or this measuring cell 27 as the case may be, engage at a holder or support 45 which guides the contact jaws 30. Connected to this holder or support 45 are the hydraulic cylinders 32'. If there are employed pressure-force measuring cells 27' the same can possibly engage directly at or be supported at the holder 45.

Figure 14:
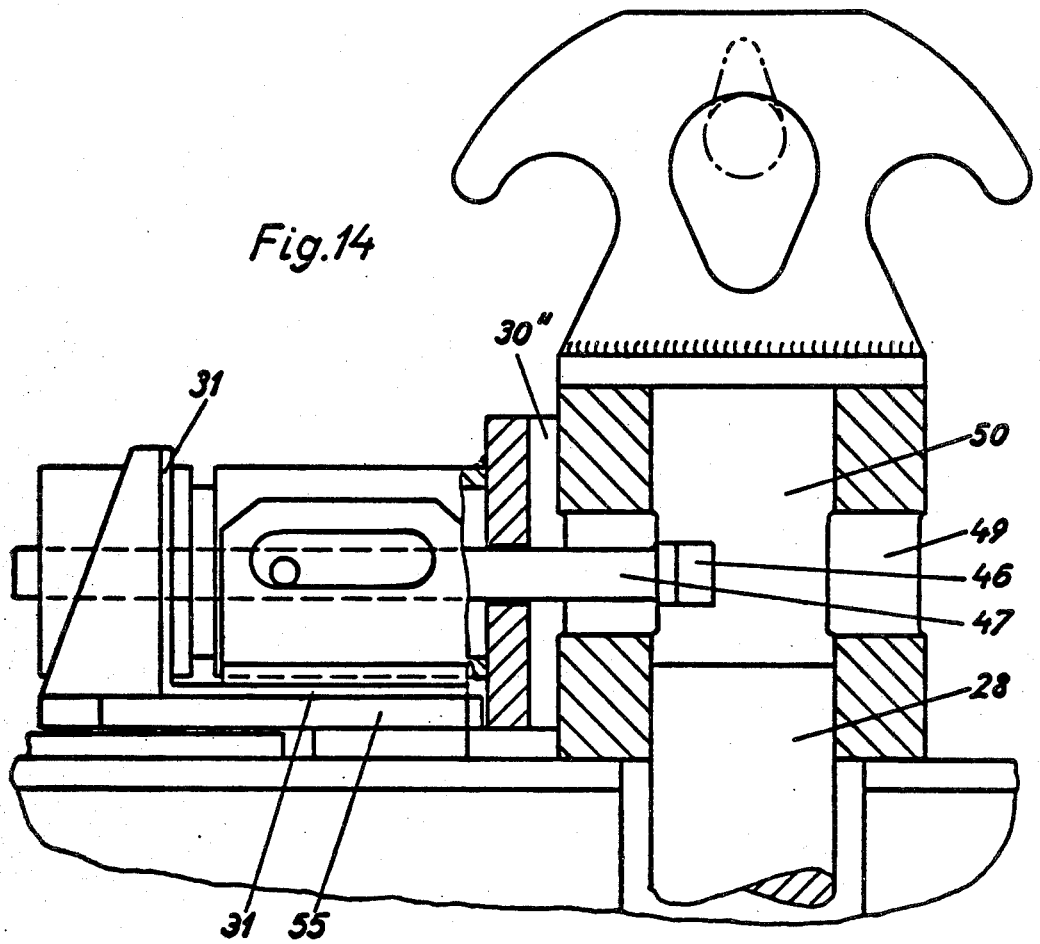
Figure 15:
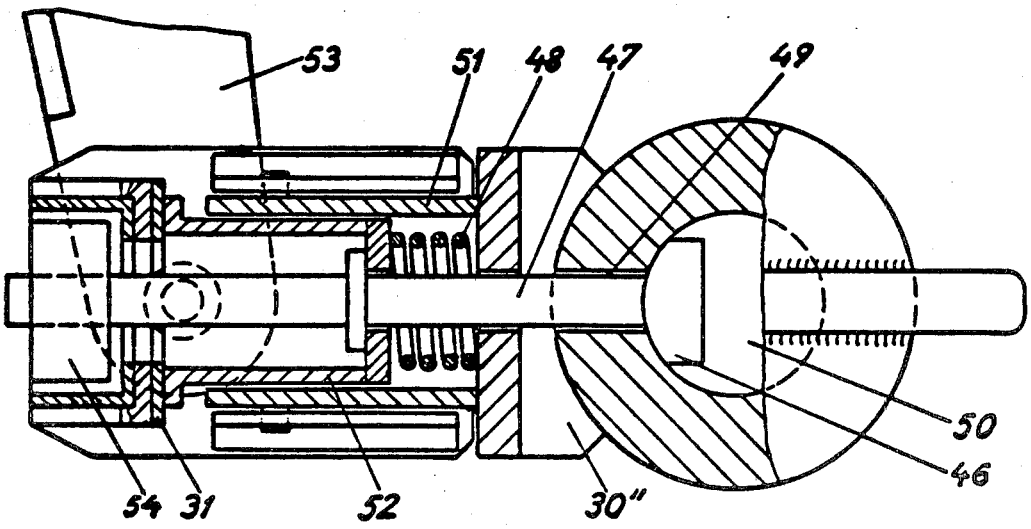

In the embodiment according to FIGS. 14 and 15 the head of the electrode 28 is provided with an axial non-circular bore 50 and two non-circular bores 49 extending transversely with respect to the axial bore 50. At this head of the electrode 28 there engages the insulated hook of the weight measuring device which is provided with here not particularly illustrated tension-force measuring cells. In the embodiment under discussion the contact jaws 30'' are pierced by a traction rod 47 provided with a hammer head 46 and impacted by a suitable spring 48. This spring 48 is arranged in a housing 51 and can be compressed, for load-relieving the traction rod 47, by means of a sleeve element 52 and a rocker 53. Furthermore, there is arranged at the housing 51 a pivoting or turning device 54 which is connected to the traction rod 47 and allows pivoting the same through an angle of 90°, so that the traction rod 47 can be inserted into the non-circular bores 49 and thereafter pivoted, so that following release of the spring 48 the hammer head 46 of the traction rod 47 bears against the inner wall of the bore 50 and presses the contact jaws 30'' against the head of the electrode 28, while the contact jaws 30'' are only loosely guided by the base plate 55.

With this embodiment there is ensured for a reliable self-clamping electrical contact action, wherein force shunts or by-pass paths are avoided with respect to the weight measurement.

Figure 16:
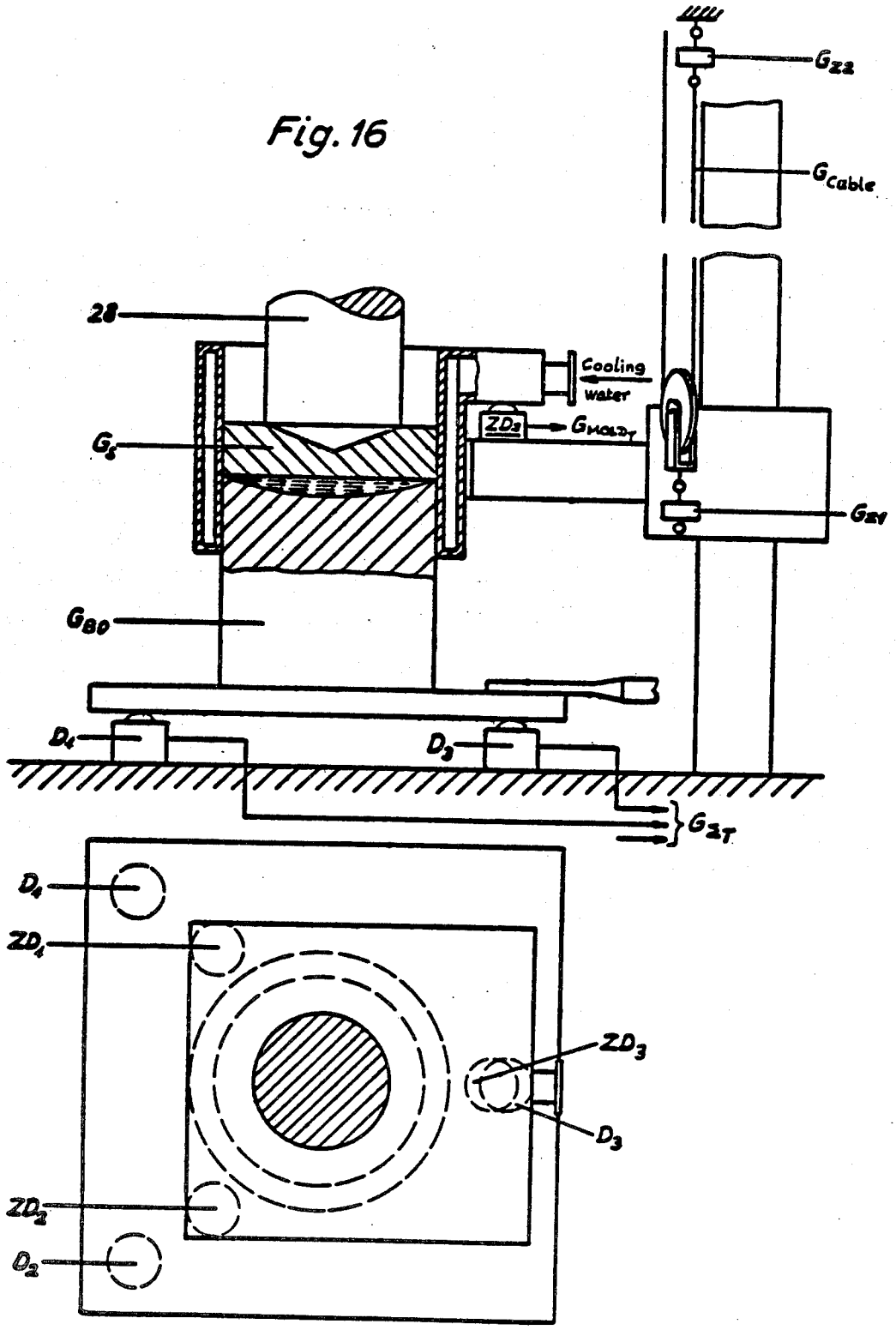

FIG. 16 illustrates an alternative to directly weighing the electrode. Here the entire ingot or block is weighed and through the increase in the block weight there is determined the molten block weight. The weighing device is formed by weight measuring cells arranged below the cooled block or ingot carriage. With lifting molds there occur considerable force shunts between the block and the mold, so that the weighing result is distorted or falsified. For this reason either the mold carriage has to be weighed, analogous to the electrode carriage in FIG. 3, or better still the mold itself is weighed by means of weight measuring cells. Consequently, the measuring values are: $G_{BO}$ block or ingot weight after the last electrode, $G_{\Sigma}$ momentary indicated apparent ingot or block weight, $G_s$ slag weight and $G_{MOLD}$ momentary appararent weight of the lifting mold. Thus, the momentary melting weight $G_G$ of the electrode is:

$$G_G = G_{\Sigma T} + G_{MOLDT} - G_S - G_{BO},$$

wherein T is the reference to taring to zero of the empty mold and ingot or block carriage.

With this arrangement the expenditure is greater than with the arrangements discussed above, but there is afforded the advantage of avoiding the affects of the current infeed lines.

While there are shown and described present preferred embodiments of the invention, it is to be distinctly understood that the invention is not limited thereto but may be variously embodied and practiced within the scope of the following claims.

Accordingly, what we claim is:

1. In a method of regulating the melting rate of a self-consumable electrode which is lowered at a lowering speed into a slag bath during electroslag remelting, while a current of measured intensity is passed through the electrode at a measured potential, wherein the lowering speed is regulated in consideration of maintaining a melting rate reference value and the current intensity and the potential are regulated in consideration of maintaining a current intensity reference value and a potential reference value, respectively, the improvement which comprises the steps of:

continuously determining an actual total electrode weight;

continuously determining the length of the electrode above the surface of the slag bath;

continuously determining the weight of the part of the electrode immersing into said slag bath from the continuously determined actual total electrode weight and the continuously determined length of the electrode above the surface of the slag bath;

comparing the determined weight of the part of the electrode immersing into the slag bath with a weight reference value;

upon deviation of the determined weight of the part of the electrode immersing into the slag bath from the weight reference value changing the ratio of the potential reference value to the current intensity reference value in such a manner so as to maintain essentially constant the product of the potential reference value and the current intensity reference value so as to essentially obtain coincidence of the determined weight of the part of the electrode immersing into the slag bath with the weight reference value;

determining the actual melting rate and comparing the determined actual melting rate with the melting rate reference value; and upon deviation from the melting rate reference value changing the product of the current intensity reference value and the potential reference value so as to essentially obtain coincidence of the determined actual melting rate and the melting rate reference value.

2. The method as defined in claim 1, further including the step of:

controlling the lowering speed of the electrode by means of the reference value of the current intensity.

3. The method as defined in claim 1, wherein:

the step of continuously determining the actual total electrode weight entails the step of weighing the self-consumable electrode.

* * * * *

UNITED STATES PATENT AND TRADEMARK OFFICE

CERTIFICATE OF CORRECTION

PATENT NO. : 4,483,708

DATED : November 20, 1984

INVENTOR(S) : MANFRED GFRERER et al

It is certified that error appears in the above-identified patent and that said Letters Patent is hereby corrected as shown below:

Column 2, line 16, delete "electorslag-remelting" and replace it with --electroslag-remelting--

Column 9, line 59, delete "$G_s$" and replace it with --$G_S$--

Signed and Sealed this

Ninth Day of April 1985

[SEAL]

*Attest:*

DONALD J. QUIGG

*Attesting Officer* *Acting Commissioner of Patents and Trademarks*